US012330008B2

(12) United States Patent
Kilby

(10) Patent No.: US 12,330,008 B2
(45) **Date of Patent: *Jun. 17, 2025**

(54) EXERCISE BAR CARRIAGE LOCKING MECHANISM

(71) Applicant: HABLAMER, LLC, Green Cove Springs, FL (US)

(72) Inventor: Frank Kilby, Lakewood, CA (US)

(73) Assignee: HABLAMER, LLC, Green Cove Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/649,753

(22) Filed: Apr. 29, 2024

(65) Prior Publication Data

US 2024/0342533 A1 Oct. 17, 2024

Related U.S. Application Data

(63) Continuation of application No. 18/334,329, filed on Jun. 13, 2023, now Pat. No. 11,998,787, which is a continuation of application No. 17/365,667, filed on Jul. 1, 2021, now Pat. No. 11,712,593.

(51) Int. Cl.
*A63B 21/00* (2006.01)
*A63B 21/062* (2006.01)

(52) U.S. Cl.
CPC .... *A63B 21/00069* (2013.01); *A63B 21/0628* (2015.10); *A63B 2225/093* (2013.01)

(58) Field of Classification Search
CPC ..... A63B 21/00069; A63B 21/0628; A63B 2225/093
See application file for complete search history.

(56) References Cited

U.S. PATENT DOCUMENTS

| | | | |
|---|---|---|---|
| 4,402,504 | A | 9/1983 | Christian |
| 4,795,149 | A | 1/1989 | Pearson |
| 5,273,506 | A | 12/1993 | Dawson, Jr. |
| 5,725,459 | A | 3/1998 | Rexach |
| 5,738,615 | A | 4/1998 | McCollum et al. |
| 6,394,935 | B1 | 5/2002 | Lake |

(Continued)

FOREIGN PATENT DOCUMENTS

| | | |
|---|---|---|
| CN | 2488548 | 5/2002 |
| CN | 1482935 | 3/2004 |

(Continued)

OTHER PUBLICATIONS

CA Application No. 3,133,708, "Examiner's Report and Search Report", dated Jan. 26, 2023, 5 pages.

(Continued)

*Primary Examiner* — Andrew S Lo
(74) *Attorney, Agent, or Firm* — Aikin & Gallant, LLP

(57) ABSTRACT

An exercise apparatus comprising: a frame; first and second vertical guides coupled to the frame; first and second carriages carried on the respective first and second vertical guides, each of the first and second carriages having an upper carriage portion, a lower carriage portion and a carriage locking mechanism operable to lock and release the lower carriage portion to a selected vertical position along the first and second vertical guides; and an exercise bar coupled to the upper carriage portion of the first and second carriages, the exercise bar operable to translate or rotate to actuate the carriage locking mechanism.

20 Claims, 13 Drawing Sheets

(56) References Cited

U.S. PATENT DOCUMENTS

| | | | |
|---|---|---|---|
| 6,447,430 | B1 | 9/2002 | Webb et al. |
| 6,623,409 | B1 | 9/2003 | Abelbeck |
| 7,455,629 | B2 | 11/2008 | Abelbeck |
| 7,488,277 | B1 | 2/2009 | Knapp |
| 7,520,843 | B1 | 4/2009 | Goddard |
| 7,549,950 | B1 | 6/2009 | Lundquist et al. |
| 7,651,443 | B1 | 1/2010 | Fenster et al. |
| 7,666,124 | B2 | 2/2010 | Vaes |
| 8,047,972 | B1 | 11/2011 | Dean et al. |
| 8,172,733 | B1 | 5/2012 | Batca |
| 8,231,509 | B2 | 7/2012 | Lunquist |
| 9,067,100 | B2 | 6/2015 | Habing |
| 9,302,139 | B2 | 4/2016 | Habing et al. |
| 9,427,612 | B1 | 8/2016 | Swanson |
| 9,707,436 | B1 | 7/2017 | Atwood et al. |
| 10,556,144 | B2 | 2/2020 | Habing et al. |
| 11,712,593 | B2 | 8/2023 | Kilby |
| 11,998,787 | B2 | 6/2024 | Kilby |
| 2002/0091043 | A1 | 7/2002 | Rexach |
| 2004/0018920 | A1 | 1/2004 | Simonson |
| 2007/0037674 | A1 | 2/2007 | Finn et al. |
| 2007/0042876 | A1 | 2/2007 | Lunquist |
| 2007/0179030 | A1 | 8/2007 | Slawinski |
| 2008/0220951 | A1 | 9/2008 | Webber |
| 2012/0065035 | A1 | 3/2012 | Makula |
| 2013/0065737 | A1 | 3/2013 | Habing |
| 2013/0184128 | A1 | 7/2013 | Towley, III et al. |
| 2013/0274075 | A1 | 10/2013 | Habing et al. |
| 2013/0296144 | A1 | 11/2013 | Gvoich |
| 2020/0114196 | A1 | 4/2020 | Habing et al. |
| 2020/0155889 | A1 | 5/2020 | Leipheimer |
| 2023/0001253 | A1 | 1/2023 | Kilby |

FOREIGN PATENT DOCUMENTS

| | | |
|---|---|---|
| CN | 202289333 | 7/2012 |
| CN | 202777697 | 3/2013 |
| WO | 2012012578 | 1/2012 |

OTHER PUBLICATIONS

BodyCraft Press Strength Training System Instruction Manual, Recreation Supply Inc., retrieved Feb. 20, 2021, 16 pages.

"Best Buy Consumer Guide," BodyCraft, retrieved from the Internet <https://web.archive.org/web/20040205104236/http://www.bodycraft.com/xpress.tpl>, Feb. 5, 2004, 2 pages.

"Press Pro," BodyCraft, retrieved from the Internet <www.bodycraft.com> on Feb. 20, 2021, 2 pages.

CA Application No. 3,133,708, "Examiner's Report and Search Report", dated Jul. 28, 2023, 3 pages.

EXERCISE BAR CARRIAGE LOCKING MECHANISM

CROSS-REFERENCE TO RELATED APPLICATIONS

This application is a continuation of U.S. patent application Ser. No. 18/334,329, filed Jun. 13, 2023, which is a continuation of U.S. patent application Ser. No. 17/365,667, filed Jul. 1, 2021, now U.S. Pat. No. 11,712,593, issued Aug. 1, 2023, which are hereby incorporated by reference.

BACKGROUND OF THE INVENTION

Field of the Invention

The present invention relates generally to the field of exercise equipment. More particularly, the invention relates to an exercise device having a Smith bar that includes carriage and locking mechanisms.

Background

Exercise equipment having a cable and pulley system for lifting a stack of weights has been in use for well over a century. Such equipment comes in a wide variety of designs for performing various exercises. Some have adjustable pulley locations where a handle is attached to a cable for pulling without a defined path of movement. Equipment of this type is often referred to as a functional trainer. One type of such exercise equipment, exemplified, for example, in U.S. Pat. No. 4,402,504, is particularly suited for upper body exercises. This apparatus has an elongated upstanding frame and a carriage that is movable up and down along vertical posts of the frame. The carriage includes one or more pulleys around which a cable is reeved. The cable is further reeved around upper and/or lower pulleys on the frame and is coupled to a source of exercise resistance, such as a plurality of stacked weights. The cable exits the pulley on the carriage and is connected to a handle or similar pulling device. The height of the handle is readily adjustable by moving the carriage on the vertical posts and locking it into position at the selected height. This permits a wide variety of exercises to be performed for exercising muscle groups of the lower and upper body. The amount of exercise resistance is adjusted by selecting more or fewer stacked weights. The range of available exercise resistance is thus determined by the quantity of available weights.

Another type of exercise apparatus is often referred to as a Smith machine. This device consists of a barbell that is fixed within a pair of steel guides, which limit the barbell to only vertical movement. Behind each vertical guide is a series of hooks, slots or holes on which the barbell can be hooked. This means that the barbell can be secured at any point, unlike an ordinary barbell that must be re-racked after a set of repetitions. This makes a Smith machine safer for those who lift without a spotter, as one only needs to twist the wrist in order to lock the barbell in place in the event that the weight becomes too great.

Most Smith machines also incorporate blocks, pegs, or other devices that can be adjusted to automatically stop the barbell at a predetermined minimum height. Unlike a free-weight barbell, the bar on a Smith machine does not move forward, backward or sideways to any appreciable extent. Because lifting on a Smith machine requires less stabilization by the lifter, lifters can usually lift more weight with a Smith machine than with a free-weight barbell. Conventional Smith machines still utilize free weights loaded onto the bar as the source of exercise resistance. Free weights are not only cumbersome to move and store, but also present severe safety hazards.

SUMMARY OF THE INVENTION

The present invention provides an apparatus for communicating exercise resistance comprising a carriage assembly with at least one upper and at least one lower pulley. First and second cable ends are reeved around the upper and lower pulleys, respectively, and are coupled to a source of selectable exercise resistance. An exercise member is fixedly coupled to one of the cable ends, or selectively coupled to the two cable ends such that movement of the exercise member away from the carriage is subject to a first exercise resistance when only one of the cable ends is attached and is subject to a second, greater exercise resistance when both cable ends are attached.

In another embodiment, a pulley on a first carriage assembly has a cable end extending from the pulley and another cable end removably attached to the carriage. The cable ends are coupled to a source of selectable exercise resistance. The cable end extending from the pulley may be used with exercise handles or bars. An exercise member is associated with a second carriage assembly above or below the first carriage assembly. The cable end extending from the pulley can attach to the second carriage to provide a first exercise resistance to the exercise member. If more resistance is desired, the cable end attached to the first carriage may be removed from the first carriage and attached to the second carriage, providing a greater resistance.

In another embodiment, an exercise apparatus includes a frame with a pair of vertical guide rods. A carriage is slidably carried on each of the guide rods. Each of the carriages has a locking mechanism to lock the carriage at a selected vertical position and a release to disengage the locking mechanism. A horizontal exercise bar (a Smith bar) is slidably carried on the guide rods. Cables are coupled to a selectable exercise resistance, each of the cables having an end fixedly or selectively coupled to either the respective carriage or to a respective bracket at the end of the Smith bar. This arrangement allows exercises performed with the Smith bar to utilize the selectable exercise resistance rather than free weights. In some aspects, the Smith bar may include actuator brackets that are configured to engage respective ones of the carriage releases so as to selectively engage and disengage the locking mechanisms upon axial rotation of the Smith bar or by hand actuated releases on the Smith bar. The actuator brackets on the Smith bar may be further configured to selectively engage and disengage an overhead frame member upon axial rotation of the bar so that the bar can be stored overhead. The exercise apparatus may further include third and fourth cables coupled to the exercise resistance, each of these cables having an end coupled to a pull point on the first and second pulley carriages, respectively. The brackets on the Smith bar are configured for fixed or selective attachment of respective ends of the third and fourth cables. Attaching these cable ends to the Smith bar increases the exercise resistance. In this embodiment, the carriages and the horizontal exercise bar may be on the same guide rods or separate guides so long as the cables can attach to both and the actuator brackets on the horizontal exercise bar are configured to engage a respective lock and release on the carriages.

Representatively, in one embodiment, the invention is directed to an exercise apparatus including a frame; first and second vertical guides coupled to the frame; first and second carriages carried on the respective first and second vertical guides, each of the first and second carriages having an upper carriage portion, a lower carriage portion and a carriage locking mechanism operable to lock and release the lower carriage portion to a selected vertical position along the first and second vertical guides; and an exercise bar coupled to the upper carriage portion of the first and second carriages, the exercise bar operable to translate or rotate to actuate the carriage locking mechanism. In some embodiments, the first and second vertical guides comprise a number of vertically spaced openings at selected vertical positions and the carriage locking mechanism comprises an engaging member that engages with one of the vertically spaced openings to lock the lower carriage portion of each of the first and second carriages to the first and second vertical guides. In some embodiments, the carriage locking mechanism comprises a positive locking mechanism that remains in a locked position until it is released. The carriage locking mechanism may include a positive locking mechanism that requires both carriage locking mechanisms to be aligned with a hole be locked simultaneously. The carriage locking mechanism of each of the first and second carriages may include an engaging member that engages the first and second vertical guides to lock the first and second carriages to the first and second vertical guides only when each engaging member is at a same vertical height along the first and second vertical guides. The carriage locking mechanism may include upper locking components coupled to the upper carriage portion and lower locking components coupled to the lower carriage portion, and the upper locking components engage or disengage with the lower locking components to lock and release the lower carriage portion to the first and second vertical guides. The carriage locking mechanism may include a bar bracket fixedly coupled to the exercise bar and a bar locking pin fixedly coupled to the bar bracket, and wherein a rotation of the exercise bar causes the bar locking pin to engage or disengage with a lower carriage bracket coupled to the lower carriage portion to lock or unlock the lower carriage portion to the first and second vertical guides. The carriage locking mechanism may include a lower carriage lever, a lower carriage bracket and a piston assembly coupled to the lower carriage portion, and wherein the rotation of the exercise bar causes a bar locking pin coupled to the exercise bar to engage with the lower carriage lever and transition the piston assembly from a locked position in which the first and second carriages are locked to the first and second vertical guides to an unlocked position which unlocks the first and second carriages from the first and second vertical guides. The piston assembly may include a housing fixedly coupled to the lower carriage portion, a piston biased toward the locked position and a flange coupling the piston to the lower carriage lever, and wherein a rotation of the lower carriage lever in a first direction forces the piston from the locked position to the unlocked position. In some aspects, a rotation of the lower carriage lever in a second direction releases the force allowing the piston to transition back to the locked position. In some aspects, prior to locking the lower carriage portion to the vertical guide, a translation of the exercise bar relative to the first and second vertical guides moves the upper carriage portion along the first and second vertical guides while the lower carriage portion remains locked at the selected vertical position.

In another embodiment, the exercise apparatus includes a frame; at least one vertical guide coupled to the frame; a carriage carried on the vertical guide, the carriage comprising an upper carriage and a lower carriage and a carriage locking mechanism operable to lock and release the lower carriage relative to the at least one vertical guide; and an exercise bar coupled to the upper carriage, the exercise bar operable to actuate the carriage locking mechanism to lock and release the lower carriage relative to the at least one vertical guide. The carriage locking mechanism may include a positive locking piston assembly coupled to the lower carriage. The piston assembly may include a housing fixedly coupled to the lower carriage, a piston and a flange operable to move the piston from a locked position in which the lower carriage is locked to the at least one vertical guide to an unlocked position in which the lower carriage is released from the at least one vertical guide. The carriage may be a first carriage, and the carriage locking mechanism only locks and releases the lower carriage relative to the at least one vertical guide when it is at a same vertical position as a carriage locking mechanism coupled to a second carriage of the exercise apparatus. The carriage locking mechanism may include upper locking components coupled to the upper carriage and lower locking components coupled to the lower carriage, and wherein the upper locking components engage or disengage with the lower locking components to lock and release the lower carriage relative to the at least one vertical guide. In some aspects, a rotation of the exercise bar causes the upper locking components to engage or disengage with the lower locking components to lock and release the lower carriage relative to the at least one vertical guide. In some aspects, the upper locking components comprise a bar bracket fixedly coupled to the exercise bar and a bar locking pin fixedly coupled to the bar bracket that engages with the lower locking components. In some aspects, the lower locking components include a lower carriage bracket fixedly coupled to the lower carriage, and a lower carriage lever pivotally coupled to the lower carriage, and wherein the bar locking pin engages with the lower carriage lever and the lower carriage bracket to release the lower carriage relative to the at least one vertical guide. In some aspects, the engagement of the bar locking pin with the lower carriage bracket couples the upper carriage to the lower carriage.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The aspects are illustrated by way of example and not by way of limitation in the figures of the accompanying drawings in which like references indicate similar elements. It should be noted that references to "an" or "one" aspect in this disclosure are not necessarily to the same aspect, and they mean at least one.

DETAILED DESCRIPTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

The terminology used herein is for the purpose of describing particular aspects only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the apparatus or associated components in use or operation in addition to the orientation depicted in the figures. For example, if the apparatus or associated components in the figures is turned over, elements described as "below" or "beneath" other elements or features would then be oriented "above" the other elements or features. Thus, the exemplary term "below" can encompass both an orientation of above and below. The apparatus or components may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
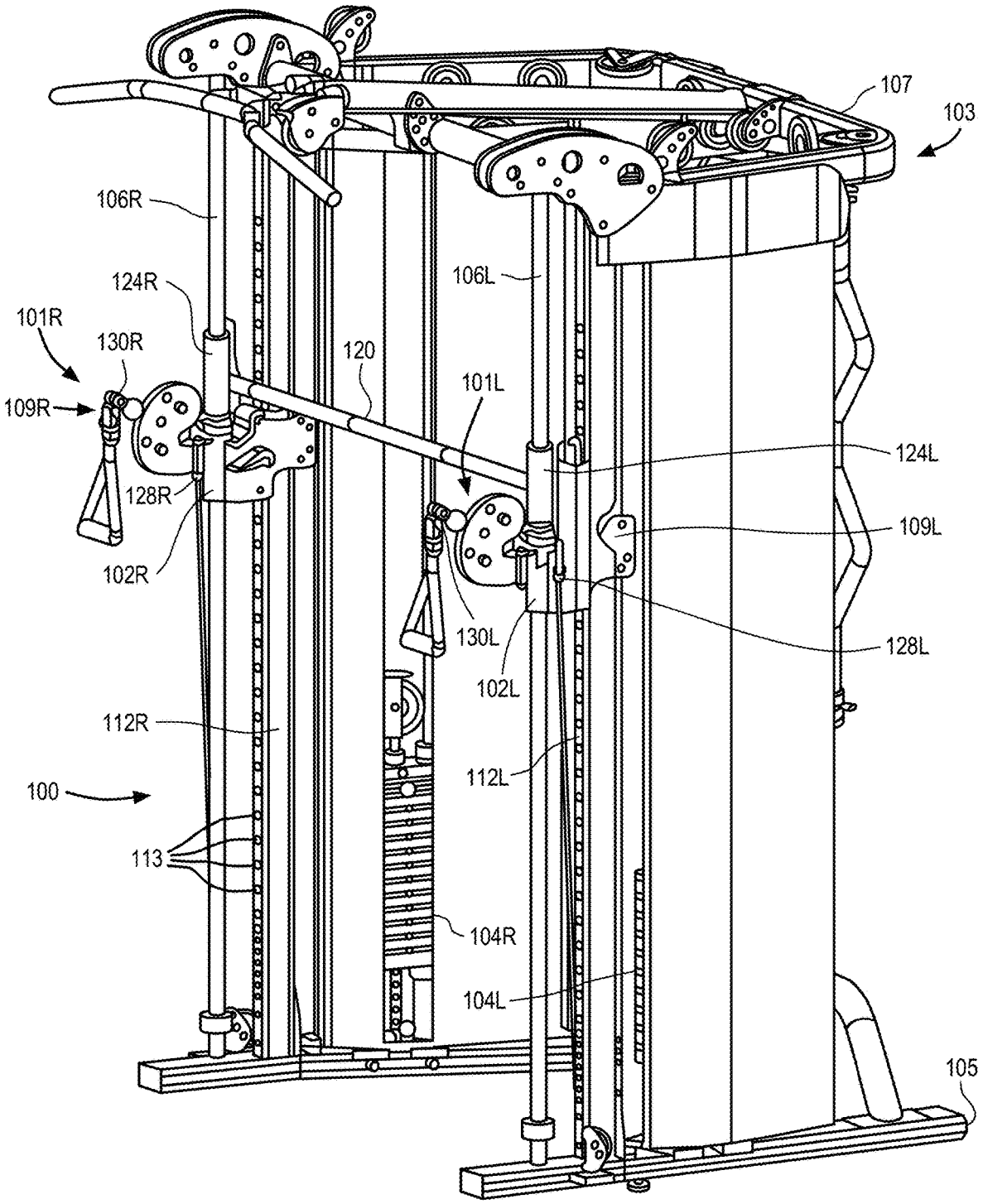
FIG. 1 illustrates an exercise apparatus in accordance with an embodiment of the invention.

FIG. 1 illustrates an exercise apparatus 100 in accordance with an embodiment of the invention. Apparatus 100 is a functional trainer with multiple pull points for performing a wide variety of exercises. Apparatus 100 may include a frame 103 for supporting the various components of the apparatus. Frame 103 may include a base portion 105, an overhead portion 107, and guide rods 106L, 106R and vertical members 112L, 112R extending between base portion 105 and overhead portion 107. Two wide, adjustable pull points 101L and 101R, shown here with D-handles, may be provided on lower carriages 102L and 102R, respectively, of the carriage assemblies 109L and 109R. The pull points are coupled to respective selectable weight stacks 104L and 104R by paired cable and pulley systems. For example, the paired pulley and cable system may be similar to that disclosed in U.S. Pat. No. 10,566,144 entitled Slidable Bar and Carriage Assembly, which is incorporated herein by reference in its entirety. It should further be understood that the terms cable and cable system disclosed herein are not limiting and are intended to encompass any flexible member, for example, any flexible line, wire, rope, fiber or the like that can be used to translate a resistance from one point to another within the system.

The carriage assemblies 109L, 109R may each include lower carriages 102L, 102R and upper carriages 124L, 124R that may move (e.g., slide) vertically along one or more of the vertical guides 112L, 112R, 106L, 106R. The lower carriages 102L, 102R may be vertically slidable on vertical members 112L and 112R, respectively, and include a sleeve that encircles guide rods 106L and 106R, respectively. The lower carriages 102L, 102R may be locked at a desired height by locking mechanisms that engage holes 113 in vertical members 112L and 112R, as will be described in more detail in reference to FIGS. 2-11.

When lower carriages 102L and 102R are positioned at a mid height, pull points 101L and 101R may be used to perform such exercises as standing chest presses, incline presses, decline presses, flys and close grip presses. When the carriages are positioned low, near the bottom of guide rods 106L and 106R, pull points 101L and 101R can be used to perform exercises such as shoulder presses, squats, bicep curl, lateral raise and front delt. When the carriages are positioned high on the guide rods, these pull points can be used to perform a wide lateral pull down.

The upper carriage 124L and 124R are coupled to ends of a Smith bar 120. The upper carriages 124L and 124R may have a sleeve like portion that encircles one of the respective guide rods 106L and 106R and slide along the rods 106L and 106R. The upper carriages 124L and 124R therefore guide the Smith bar 120 along guide rods 106L and 106R. As will be explained more fully in reference to FIGS. 2-11, the Smith bar 120 can be coupled to the weight stacks 104L and 104R to perform exercises commonly performed on conventional Smith machines, such as squats, dead lifts, bench press, incline press, shoulder press, decline press and upright row. Coupling the selectable weight stacks to the Smith bar eliminates the need to use free weights, as is the case with conventional Smith machines.

When not in use, the Smith bar 120 may be stowed on overhead portion 107 using any suitable storage or locking mechanism, for example, a catch and latch type mechanism. An additional safety lock can be swiveled under the Smith bar 120 to prevent falling if the Smith bar 120 is accidentally rotated. The Smith bar 120 rotates axially and may be removed from its stowed position by rotating the bar to disengage the storage or locking mechanism.

To perform exercises with the Smith bar 120, carriages 102L and 102R may first be brought to a mid position at equal heights on guide rods 106L and 106R. The Smith bar 120 is then removed from its stowed position and brought down to the carriages. Cable ends 128L and 128R, which may normally be hooked onto the respective carriages, may be unhooked from the carriages and slid over to hook onto the Smith bar, thereby coupling the Smith bar 120 to the weight stacks 104R and 104L.

The Smith bar 120 may further include brackets to engage the lower carriages 102L and 102R so that rotating the bar allows the upper and lower carriages to move up and down on the guide rods 106L, 106R using the Smith bar 120 to move them. In some aspects, the lower carriages 102L, 102R may remain locked and work as a safety when performing exercises such as squats. For example, the bar and carriages may first be lowered to a desired safety position. Then the bar may be rotated to lock the carriages in place. The selected exercise weights may remain attached to the bar by virtue of the cable ends 128L and 128R being hooked onto the Smith bar 120. When done exercising, the bar may be brought back down to pick up the carriages. The exerciser then stands up and allows the carriages to lock into place. The Smith bar 120 may then be left with the carriages or brought to the top and stored on the overhead portion. An additional safety lock may be engaged with the Smith bar 120 when stored.

The exercise apparatus 100 may further include a weight multiplier for doubling the exercise resistance applied to Smith bar 120. To engage the weight multiplier, the cable ends 130L and 130R of pull points 101L and 101R may be attached to the ends of the Smith bar 120.

FIGS. 2-11 illustrate perspective views of a carriage assembly including a carriage locking mechanism of the exercise apparatus of FIG. 1. It should be understood that while a single carriage locking mechanism on one side of the exercise apparatus is shown in the Figures, for example a left side carriage locking mechanism, a second carriage locking mechanism is on the other side of the exercise apparatus (e.g., a right side locking mechanism) that functions in the same manner as that shown and described in FIGS. 2-11. Carriage locking mechanism 200 may therefore be understood as having both a left side (L) locking mechanism and a right side (R) locking mechanism. In some aspects, both the left and right side locking mechanisms must be locked before further operation and/or adjustment of the carriage and/or bar assemblies can occur. Representatively, the left and right side locking mechanisms are configured such that both must be locked to the vertical member at a same vertical height before movement of the Smith bar can be used to unlock the lower carriage to allow for vertical movement of the lower carriage. The carriage locking mechanism may therefore be used to set the height of the Smith bar 120 starting position. In some aspects, the carriage locking mechanism 200 may be considered a positive locking feature and each side must be lined up with a hole or opening in the vertical member before the carriages can be locked to uprights for a starting point of exercise resistance. This keeps the exercise bar horizontal and lined up properly with the uprights for smooth operation.

Figure 2:
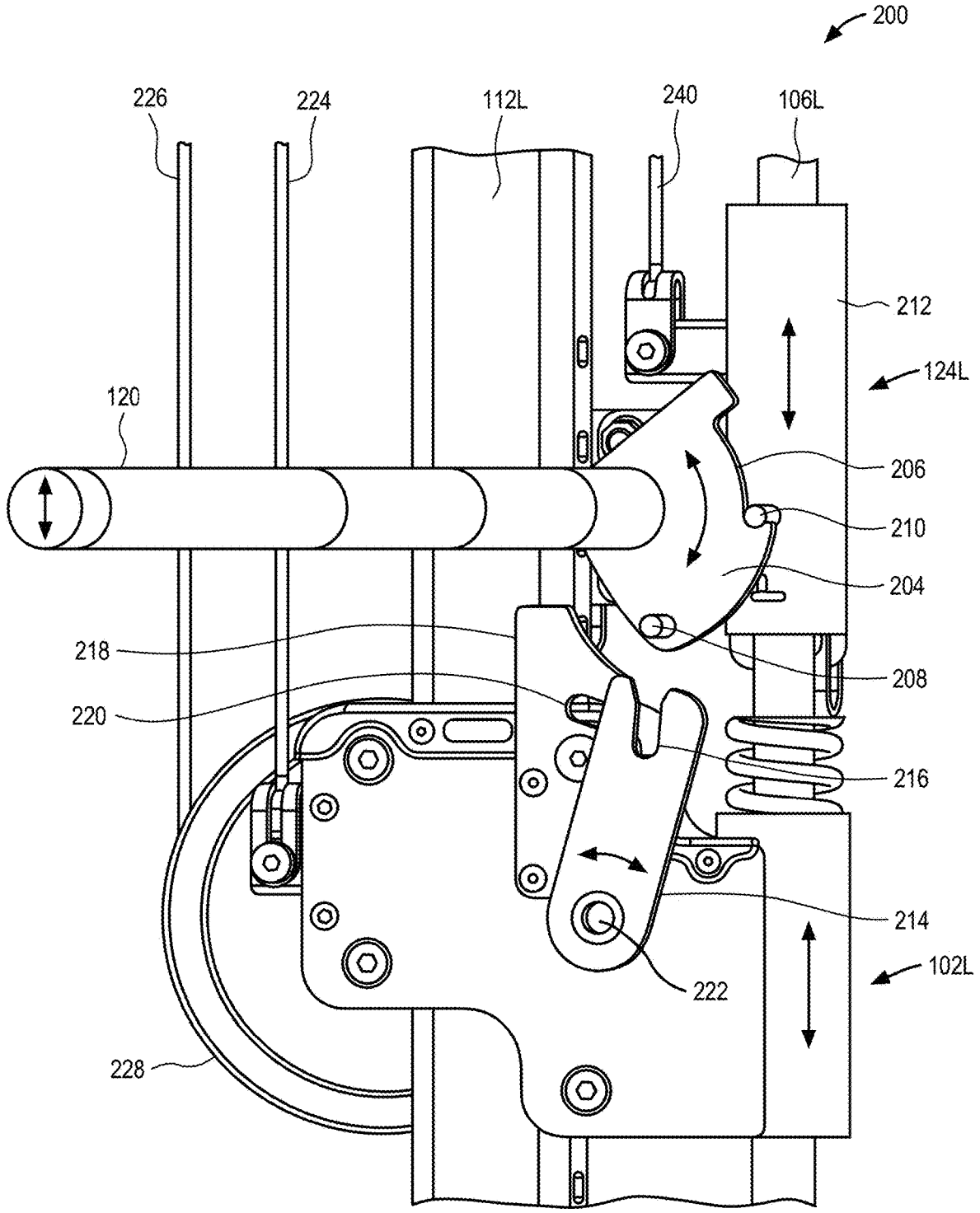
FIG. 2 illustrates a side perspective view of a carriage locking mechanism of the exercise apparatus of FIG. 1.

The carriage locking mechanism 200 may include upper locking components associated with the Smith bar 120 and upper carriage 124L, and lower locking components associated with the lower carriage 102L. The upper locking components may include, for example, a Smith bar 120 rotationally associated with the upper carriage sleeve 212 such that up and down movement of the Smith bar 120 also moves the upper carriage sleeve 212 up and down respectively, a bar bracket 204 coupled to an end of the Smith bar 120, a bar bracket notch 206 formed in a side of the bar bracket 204 and a bar locking pin 208 extending from a face of the bar bracket 204. The bar bracket 204 is fixedly coupled to an end of the Smith bar 120 such that a rotation of the Smith bar 120 also rotates the bar bracket 204 as shown by the arrow. Rotation of the bar bracket 204, in turn, causes the bar bracket notch 206 to move relative to an upper carriage pin 210 fixedly coupled to an upper carriage sleeve 212 which slides along the guide rod 106L. Rotation of the bar bracket 204 causes the bar bracket notch 206 to catch the upper carriage pin 210 at a stop at one end or another of the bracket notch 206. When the bar bracket notch 206 catches the upper carriage pin 210 at its lower stop as shown in FIG. 2, the Smith bar 120 may be lowered to rest on the lower carriage 102L and the bar locking pin 208 will slide into lever notch 216 of the lower carriage lever 214. The upper carriage sleeve 212 may further be coupled to a counterbalance by a cable 240 that counterbalances the weight of the Smith bar 120.

In the configuration shown in FIG. 2, the Smith bar 120 is considered to be in an unlocked position relative to the lower carriage 102L in that it is not locked to the lower carriage 102L. Accordingly, a vertical movement of the Smith bar 120 and the upper carriage sleeve 212 along the guide rod 106L will be independent of the lower carriage 102L and will not cause the lower carriage 102L to move. The lower carriage 102L, in this configuration, is actually locked to the vertical member 112L and unable to move up or down. In addition, it should be understood that when the Smith bar 120 and the upper carriage sleeve 212 are in this unlocked position, a resistance (e.g., weight stack 104L) may not yet be coupled to the Smith bar 120.

To facilitate locking of the Smith Bar 120 to the lower carriage 102L, the bar bracket 204 further includes a bar locking pin 208. The bar locking pin 208 engages with lower locking components of the carriage locking mechanism 200 to lock the Smith Bar 120 to the lower carriage 102L.

The lower locking components of the carriage locking mechanism 200 may include a lower carriage lever 214 having a lever notch 216 and a lower carriage bracket 218 including a bracket notch 220. The lower carriage lever 214 may be rotatably coupled to the lower carriage 102L. The lever notch 216 may be a substantially vertically oriented notch formed at an end of the lower carriage lever 214. The lever notch 216 may be formed at an end of the lower carriage lever 214 that faces the bar locking pin 208 such that an opening of the lever notch 216 is aligned with the bar locking pin 208 when upper carriage pin 210 is against the lower stop of bar bracket 204. The lower carriage bracket 218 may be fixedly coupled to the lower carriage 102L. The bracket notch 220 may be a substantially horizontally oriented notch formed at a side of the lower carriage bracket 218 facing the bar locking pin 208 and the lower carriage lever 214.

Figure 3:
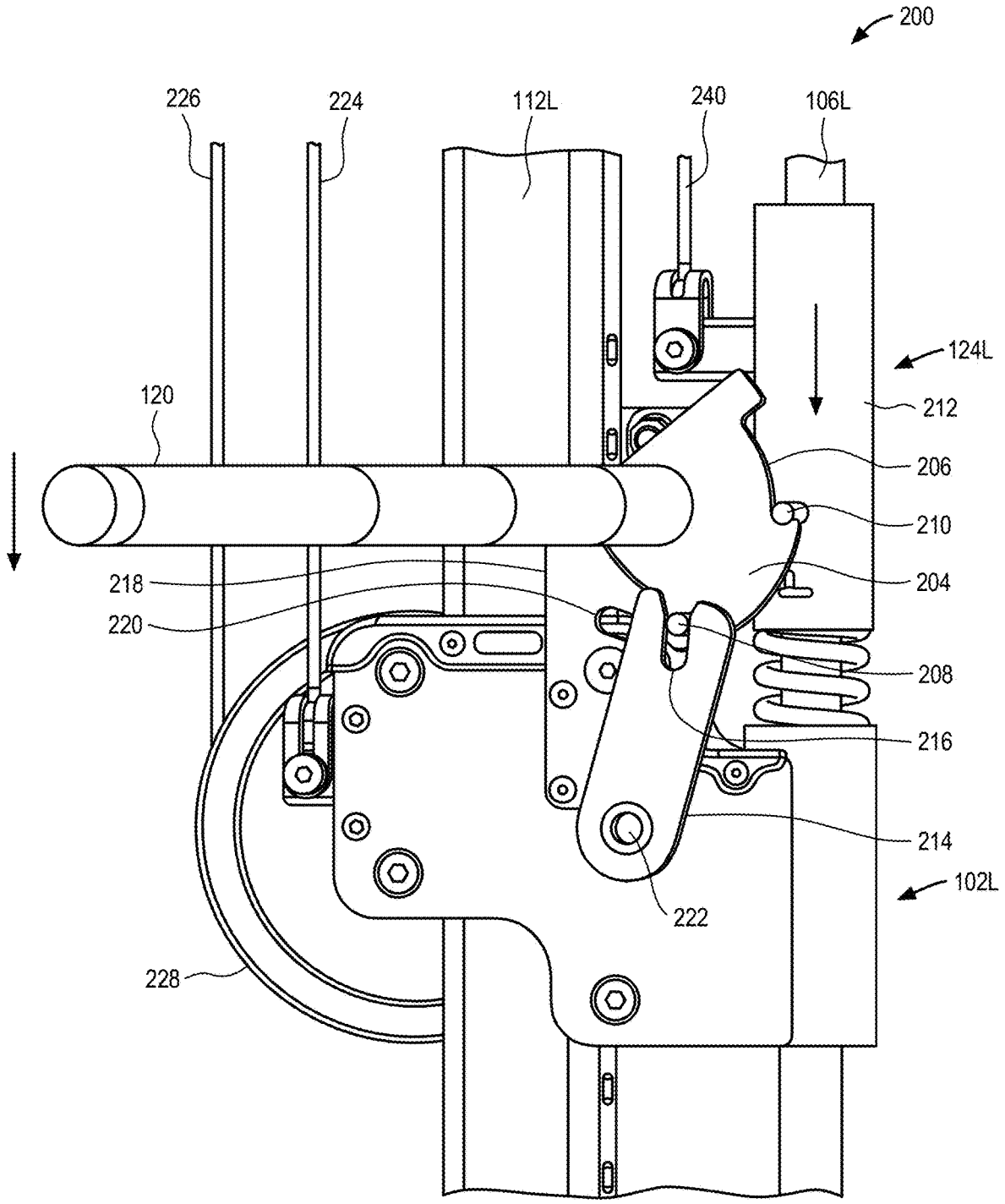
FIG. 3 illustrates a side perspective view of a carriage locking mechanism of the exercise apparatus of FIG. 1.

To lock the upper carriage 124L to the lower carriage 102L, the Smith bar 120 is moved vertically downward so that the bar locking pin 208 is inserted into the lever notch 216. The insertion of the bar locking pin 208 into the lever notch 216 is shown in FIG. 3. Once the bar locking pin 208 is positioned within the lever notch 216, it becomes aligned with the horizontally oriented bracket notch 220 in the lower carriage bracket 218. The Smith bar 120 is then rotated in the direction shown by the arrow (e.g., forward), which in turn, causes the bar locking pin 208 to move toward the lower carriage bracket 218 and into the horizontally oriented bracket notch 220. It is noted that the bar locking pin 208 also remains inserted in the lever notch 216. In particular, the lower carriage lever 214 is rotatably coupled to the lower carriage 102L at pivot point 222 such that the movement of the bar locking pin 208 toward the bracket notch 220 also pivots the lower carriage lever 214 toward the bracket notch 220. Thus, the bar locking pin 208 engages both the bracket notch 220 and the lever notch 216 when the Smith bar 120 is rotated as described. The insertion of the bar locking pin 208 into the bracket notch 220 and lever notch 216 is shown in FIG. 4.

Figure 4:
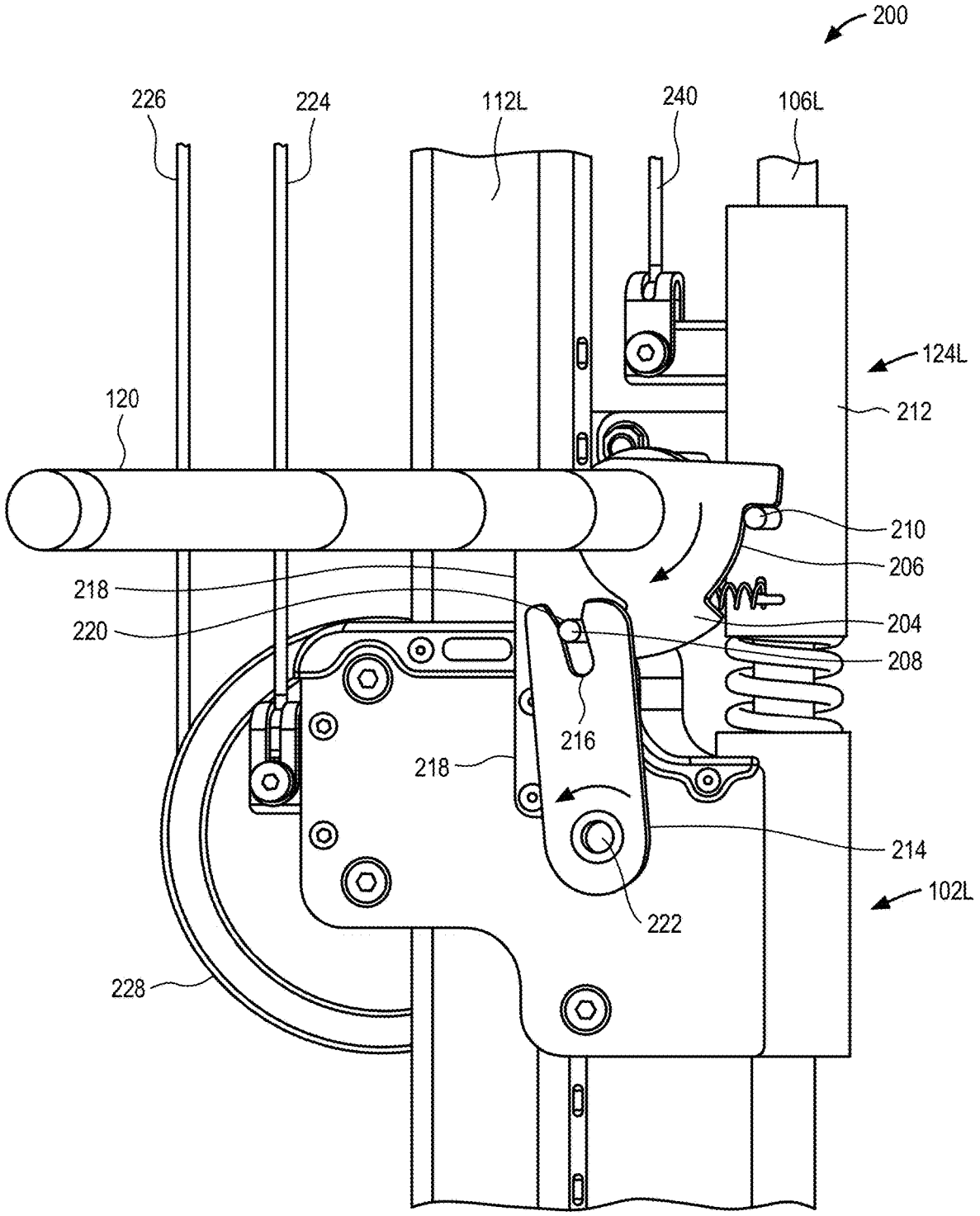
FIG. 4 illustrates a side perspective view of a carriage locking mechanism of the exercise apparatus of FIG. 1.

It can further be seen from FIG. 4 that when the Smith bar 120 is lowered and rotated as discussed, the upper stop (as opposed to the lower stop) of the bar bracket notch 206 now catches the upper carriage pin 210 of the upper carriage 124L and the bracket notch 220 of the lower carriage bracket 218 catches the bar locking pin 208 thereby preventing the upper carriage 124L from separating from the lower carriage 102L. This engagement between the upper carriage pin 210 and the upper stop of the bar bracket notch 206 along with the engagement of the bar locking pin 208 with bracket notch 220 of the lower carriage bracket 218 facilitates locking of the upper carriage 124L to the lower carriage 102L. This allows the Smith bar 120 to adjust the lower carriage 102L vertically for different starting points of resistance and safety ending positions. A resistance (e.g., weight stack 104L) may further be coupled to the upper carriage 124L using the cable 226 and pulley 228 to provide resistance when lifting the Smith bar 120. In addition, a cable 224 is shown coupled to the lower carriage 102L. The cable 224 may couple the carriage 102L to a counterbalance to counterbalance the weight of the lower carriage 102L.

In addition to locking or unlocking the lower carriage 102L relative to the upper carriage 124L, the rotation of the Smith bar 120 also locks or unlocks the lower carriage 102L from the vertical member 112L. In particular, as previously discussed, prior to locking of the upper and lower carriages 124L, 102L together, the lower carriage 102L is locked to the vertical member 112L at a particular vertical position. The lower carriage 102L must therefore be unlocked from the vertical member 112L before the Smith bar 120 (now locked to the lower carriage 102L) can be moved vertically, for adjustment of a start position and new lock position of the lower carriage 102L. It is noted that although not shown, the right side upper and lower carriages 124R, 102R are also locked to the right side vertical member 112R at the same vertical position. The operation of the locking components for locking or unlocking of the lower carriage 102L relative to the vertical member 112L will now be discussed in more detail in reference to FIGS. 5-7.

Figure 5:
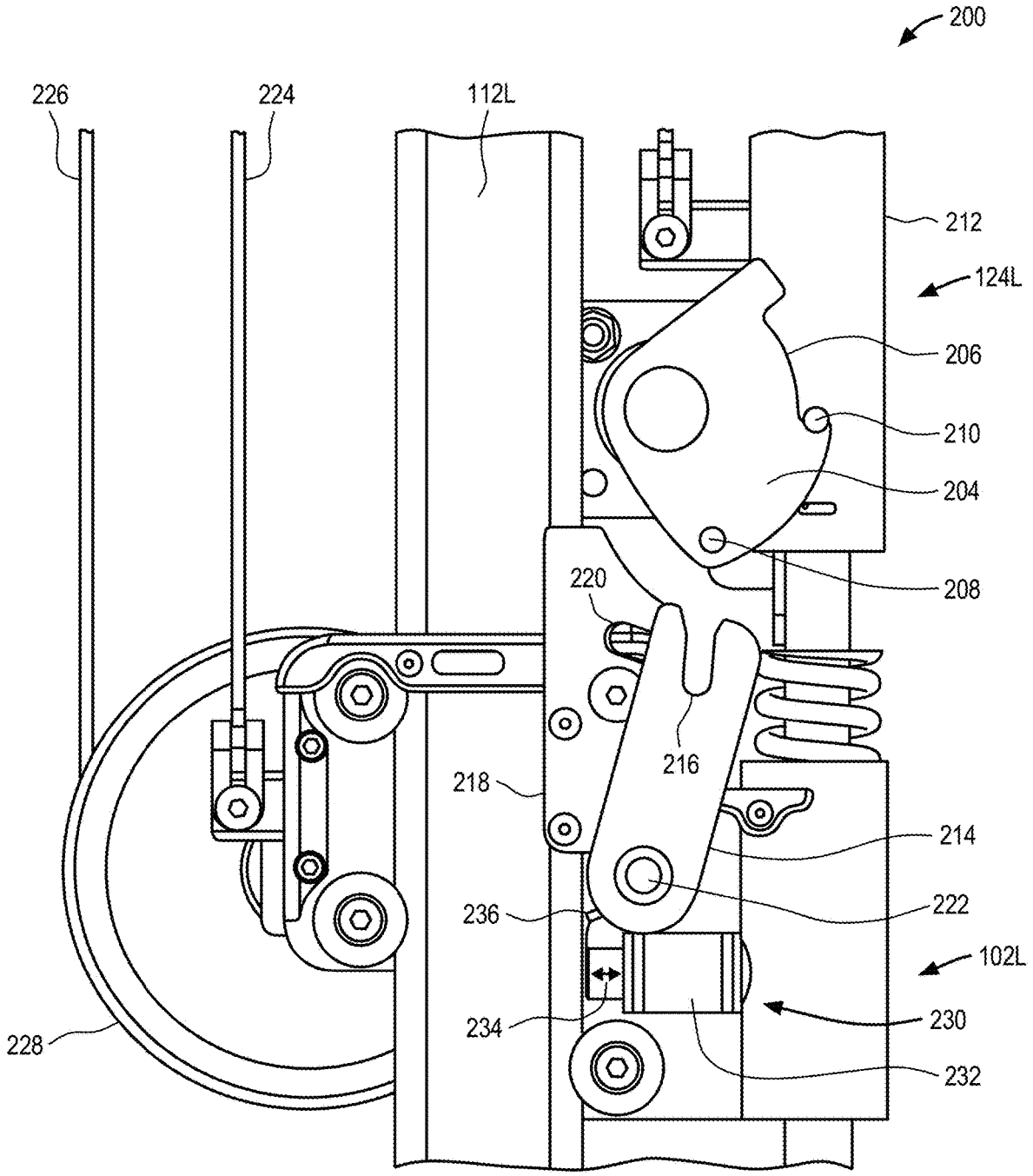
FIG. 5 illustrates a side perspective view of a carriage locking mechanism of the exercise apparatus of FIG. 1.
Figure 6:
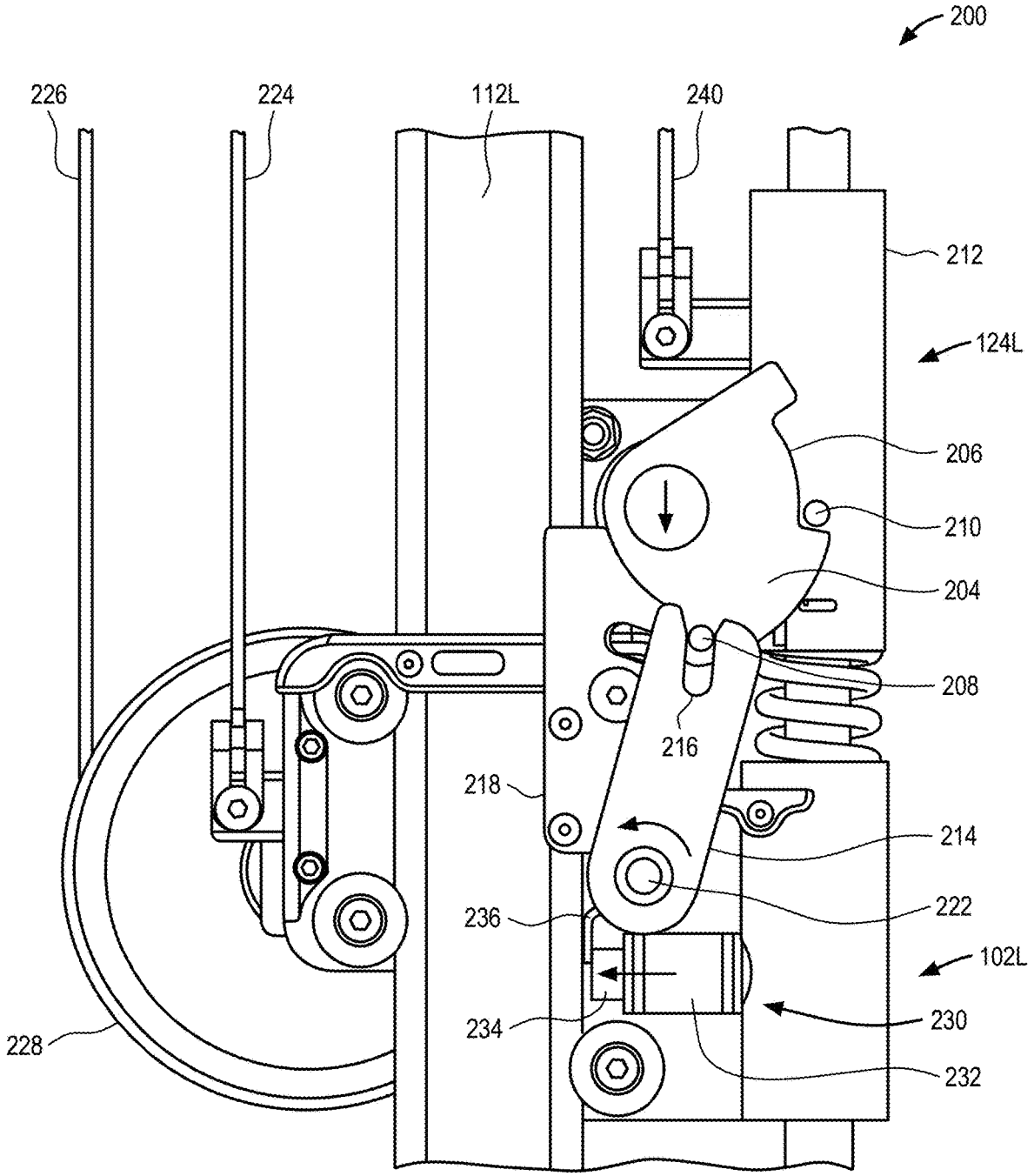
FIG. 6 illustrates a side perspective view of a carriage locking mechanism of the exercise apparatus of FIG. 1.
Figure 7:
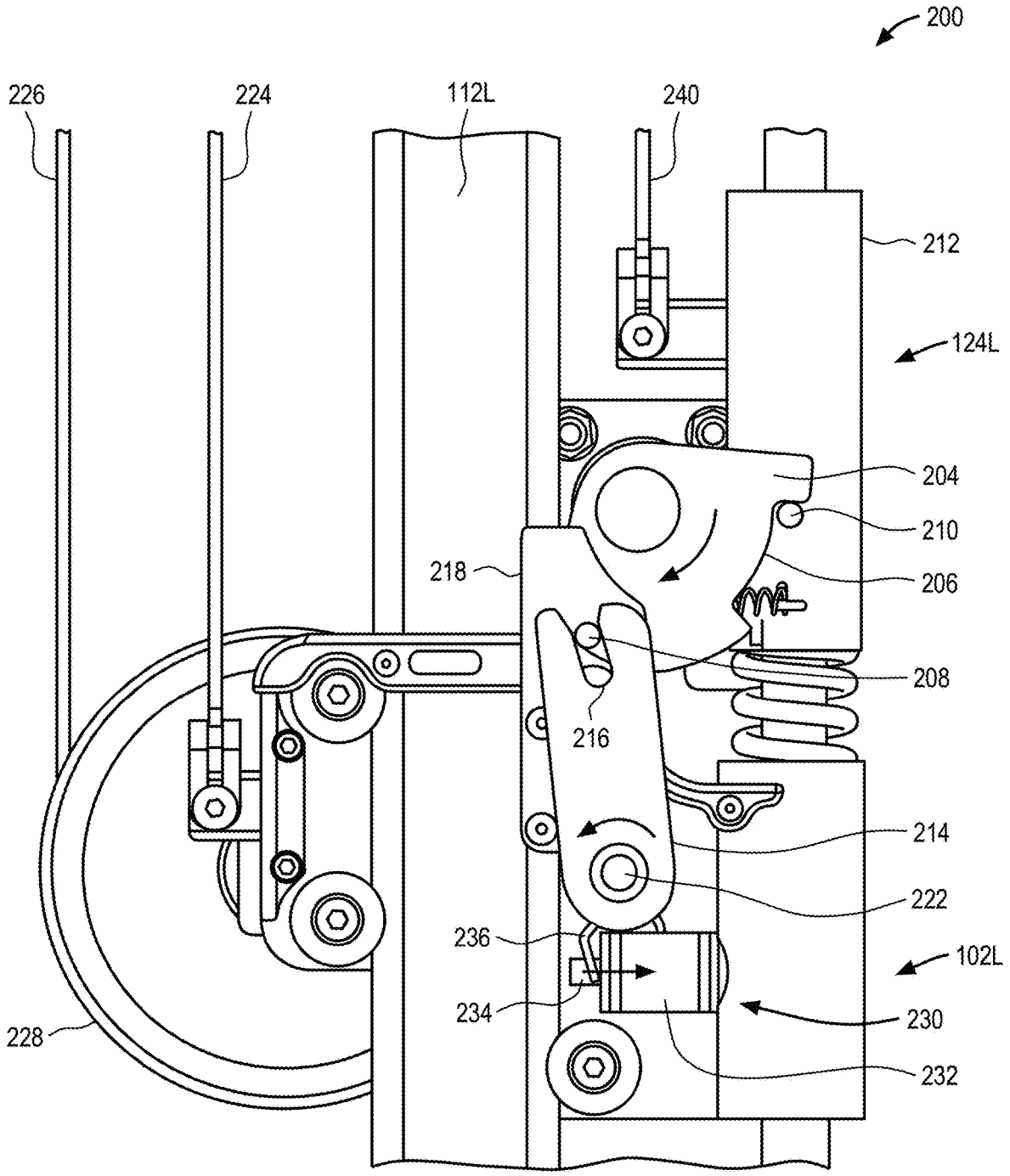
FIG. 7 illustrates a side perspective view of a carriage locking mechanism of the exercise apparatus of FIG. 1.

Representatively, FIGS. 5-7 illustrate side views of the same carriage locking mechanism previously discussed in reference to FIGS. 1-4. In FIGS. 5-7, however, the lower locking components of the carriage locking mechanism for locking or unlocking the lower carriage 102L to the vertical member 112L are further shown. In particular, it can be seen from FIGS. 5-7 that the lower locking components further include a locking assembly 230 for locking or unlocking the lower carriage 102L to the vertical member 112L. The locking assembly 230 may include a housing 232 fixedly coupled to the lower carriage 102L, a piston 234 coupled to the housing 232 and a flange 236 coupling the piston 234 to the lower carriage lever 214. In this aspect, the locking assembly 230 may also be referred to herein as a piston assembly. The piston 234 may be oriented such that it faces vertically spaced openings formed along the vertical member 112L and is operable to slide or translate relative to the housing 232. The piston 234 is sized to fit within the openings in the vertical member 112L. In this aspect, the piston 234 can be moved toward the vertical member 112L to engage with an opening in the vertical member 112L or can be moved away from the vertical member 112L to disengage with an opening in the vertical member 112L. An engagement of the piston 234 with an opening in the vertical member 112L locks the lower carriage 102L to the vertical member 112L so that it remains at the same vertical position until the piston 234 is removed from the opening. Once the piston 234 is removed from the opening, the lower carriage 102L is once again free to slide along the vertical member 112L.

The movement of the piston 234 may be caused by the movement of the lower carriage lever 214. Representatively, as previously discussed, the piston 234 is coupled to the lower carriage lever 214 by flange 236. The flange 236 may include one end that is attached to the lower carriage lever 214 and another end seated against a ridge of the piston 234. The piston 234 may be biased toward the engaged position. In this aspect, the default position is for the lower carriage 102L to remain locked to the vertical member 112L. This default lock position is shown in FIGS. 5 and 6. To disengage the piston 234 from the vertical member 112L, the bar locking pin 208 is lowered from the position shown in FIG. 5 into the lever notch 216 of the lower carriage lever 214 as shown in FIG. 6 by lowering the Smith bar 120 (not shown). Once the bar locking pin 208 engages the lever notch 216 as shown in FIG. 6, the bar locking pin 208 is moved toward the lower carriage bracket 218 by rotating the Smith bar 120 (e.g., forward toward the upper carriage sleeve 212) as previously discussed, which in turn causes the lower carriage lever 214 to rotate toward the lower carriage bracket 218 as shown by the arrow. This rotation of the lower carriage lever 214 causes the flange 236 to move the piston 234 away from the vertical member 112L as shown by the arrow in FIG. 7. The movement of the piston 234 away from the vertical member 112L pulls the piston 234 out of the opening in the vertical member 112L to the unlocked position shown in FIG. 7. Once in this unlocked position with the piston 234 disengaged from the opening of the vertical member 112L, the lower carriage 102L is now free to move along the vertical member 112L along with the upper carriage 124L. This movement allows for the vertical height of the lower carriage 102L to be adjusted to any one of the vertically spaced openings along the vertical member 112L and locked at the start height position desired by the user. Since the upper carriage 124L is also locked to the lower carriage 102L in this position, and the Smith bar 120 (see FIG. 4) is pivotally connected to the upper carriage 124L, the vertical position of the lower carriage 102L can be adjusted by raising or lowering the Smith bar 120. As previously discussed, although only one carriage locking mechanism 200 is described, both the left and right side locking mechanisms must be locked before further operation and/or adjustment of the carriage and/or Smith bar 120 can occur. In addition, the left and right side locking mechanisms 200 are configured such that both must be locked to the vertical member 112L at a same vertical height before movement of the Smith bar 120 can be used to unlock the lower carriage 102L to allow for vertical movement of the lower carriage 102L. As previously discussed, the carriage locking mechanism 200 may be used to set the height of the Smith bar 120 starting position. For example, the carriage locking mechanism 200 may be a positive locking mechanism in which each one must be lined up with a hole or opening (e.g., opening 113) in the vertical member 112L at a same vertical height before the locking mechanism 200 can be locked to the vertical member 112L by using the Smith bar 120 for a starting point of exercise resistance. This keeps the Smith bar 120 horizontal and lined up properly with the uprights for smooth operation.

Figure 8:
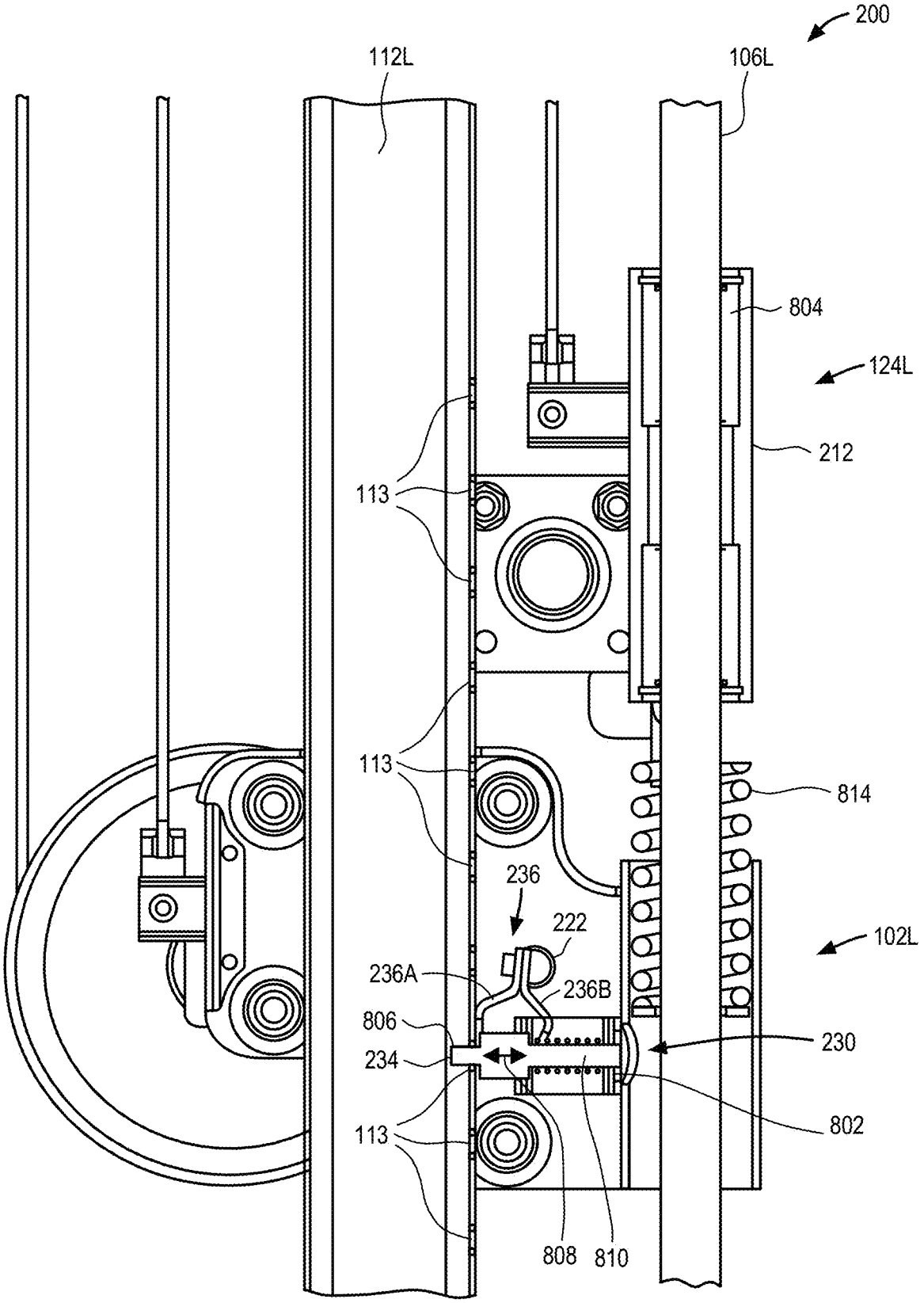
FIG. 8 illustrates a side perspective view of a carriage locking mechanism of the exercise apparatus of FIG. 1.
Figure 9:
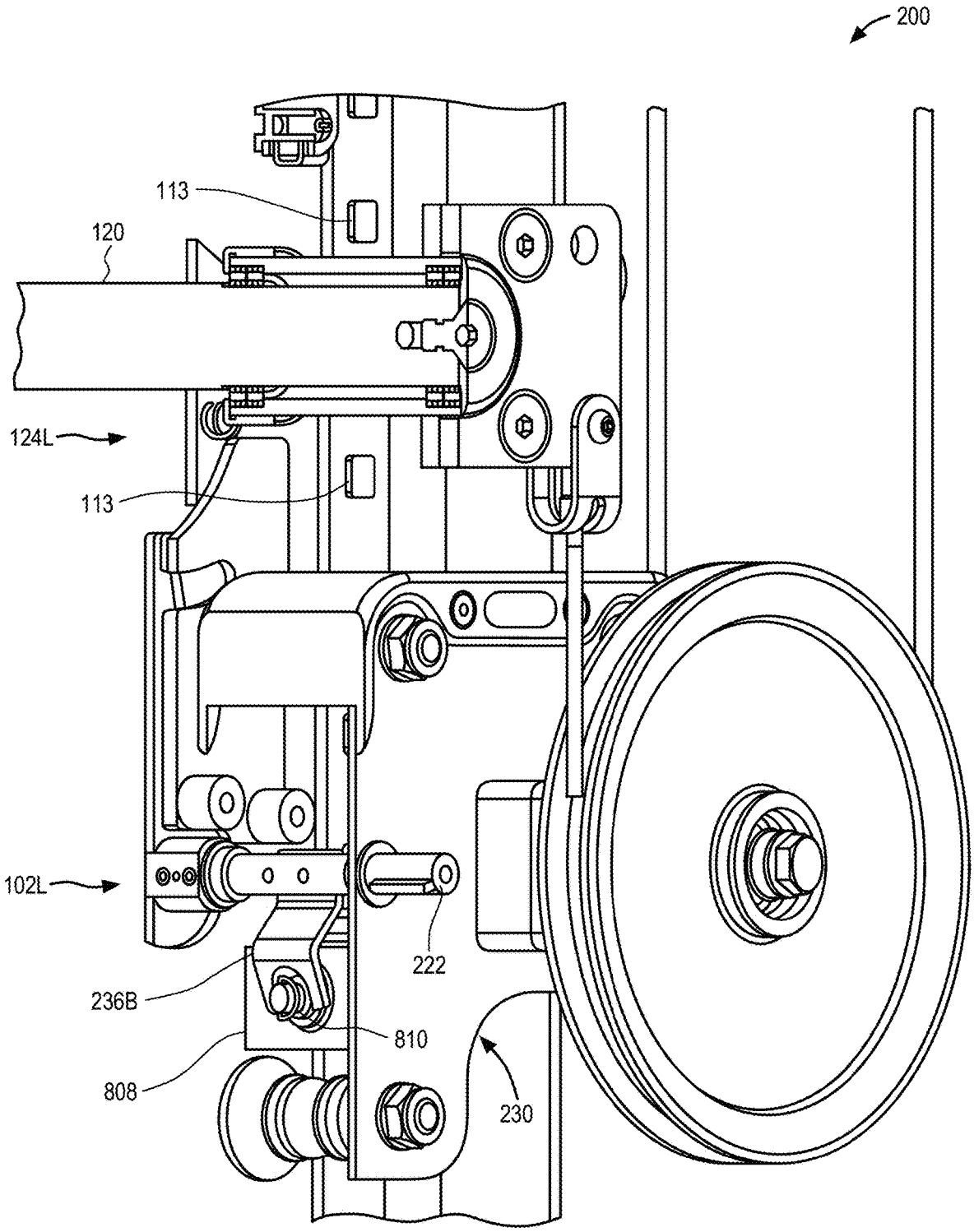
FIG. 9 illustrates a front side perspective view of a carriage locking mechanism of the exercise apparatus of FIG. 1.
Figure 10:
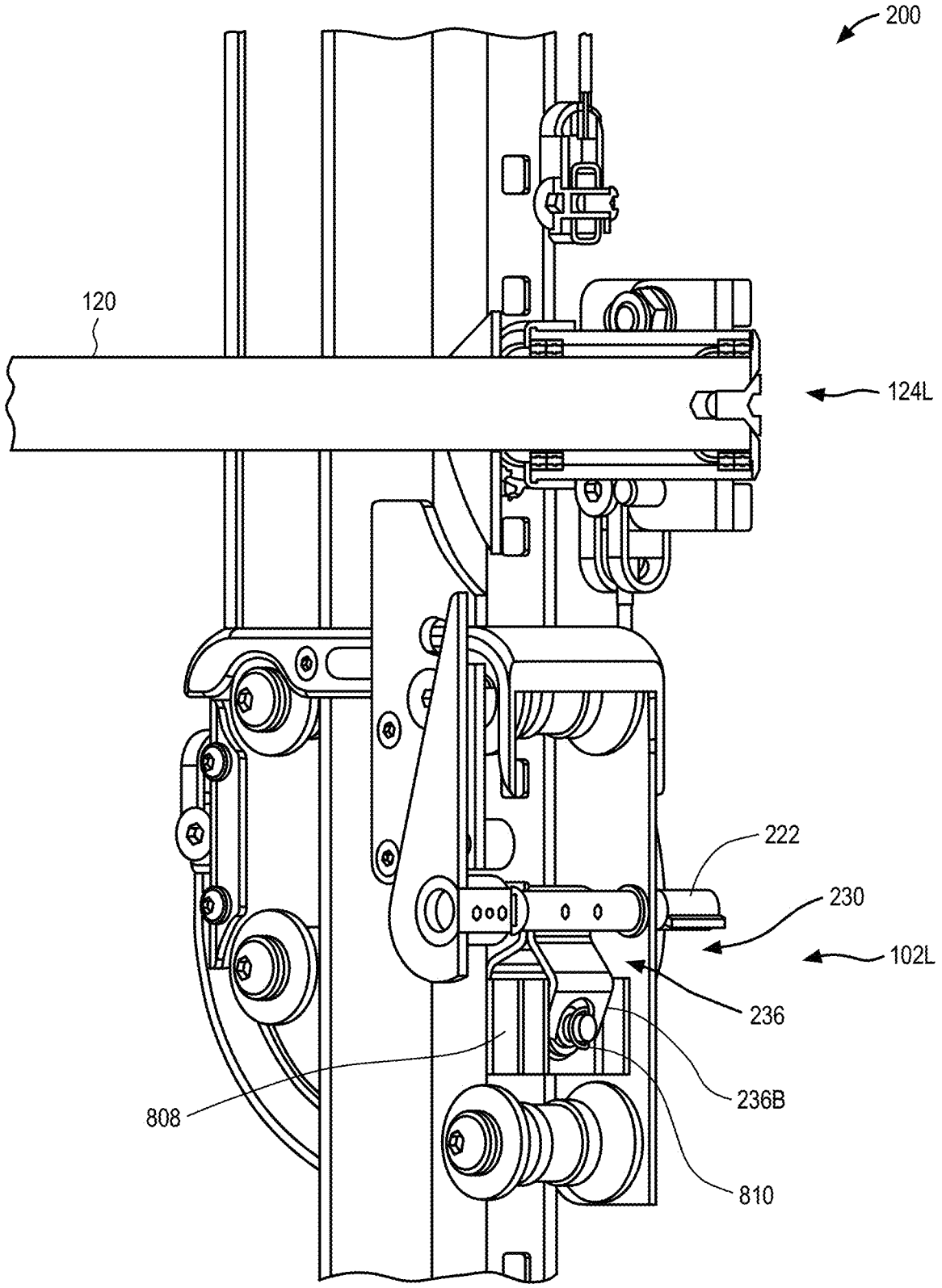
FIG. 10 illustrates a front side perspective view of a carriage locking mechanism of the exercise apparatus of FIG. 1.

FIGS. 8-10 illustrate perspective views of the piston assembly described in reference to FIGS. 5-7, which will now be discussed in more detail. Representatively, in FIGS. 8-10, are cross section views where portion(s) of the lower carriage 102L are removed so that aspects of the piston assembly 230 mounted within the lower carriage 102L can be more clearly seen. From this view, it can be seen that flange 236 includes one end connected to the pivot point 222 (e.g., a bar member) and another end defined by a first arm 236A and a second arm 236B. The first arm 236A and the second arm 236B form a "Y" shaped structure and are attached at different locations along ridges of piston 234. Representatively, the piston 234 may include an engaging portion 806, a flange attachment portion 808 and a biasing portion 810. The engaging portion 806 may be sized and dimensioned for insertion within the vertical member openings at the desired vertical position as previously discussed. The flange attachment portion 808 may be a wider portion of the piston 234 that facilitates the contact of the flange first and second arms 236A-B to the piston 234. Representatively, the first arm 236A may contact the piston 234 at a location that is in front of the flange attachment portion 808 (e.g., between the engaging portion 806 and the portion 808). The second arm 236B may contact the piston 234 at a location that is behind the flange attachment portion 808 (e.g., between the biasing portion 810 and the portion 808).

As the flange 236 is caused to rotate about the pivot 222 by the lower carriage lever (not shown) as previously discussed, the first and second arms 236A-B will either allow the piston 234 to remain in the forward (or locked) position in which the engaging portion 806 is positioned in an opening 113 in the vertical member 112L (e.g., locked position) or pull the piston 234 to a rearward (or unlocked) position in which the engaging portion 806 disengages the opening 113 in the vertical member 112L (e.g., unlocked position). For example, when the flange 236 is rotated about the pivot 222 in a counterclockwise direction, the first arm 236A pushes the piston 234 rearward causing the engaging portion 806 to be removed from the opening 113 in the vertical member 112L. On the other hand, when the flange 236 is rotated about pivot 222 in a clockwise direction, the second arm 236B (along with the biasing member 802) pushes the engaging portion 806 toward the vertical member 112L causing it to re-engage with an opening 113 in the vertical member 112L. The biasing portion 810 is configured to support the biasing member 802 which biases the piston 234 toward the locked position. The biasing member 802 may be, for example, a spring that is positioned around the biasing portion 810, between the attachment portion 808 and the end of the piston housing.

From this view, it can also be seen that a linear bearing 804 is positioned within the upper carriage sleeve 212 of the upper carriage 124L. The linear bearing 804 may be configured to facilitate the movement (e.g., sliding) of the upper carriage 124L (and any resistance coupled thereto) along the guide rod 106L with greater case. In addition, a spring 814 may be positioned along the guide rod 106L, between the upper carriage 124L and the lower carriage 102L, to help prevent or otherwise reduce impact between the upper carriage 124L and lower carriage 102L when one moves relative to the other.

FIG. 9 and FIG. 10 illustrate front side perspective views of the piston assembly 230. From these views, it can be seen that the pivot 222 is a bar like member and one end of the flange 236 is attached to the pivot 222. The second arm 236B of the flange 236 is shown attached behind the attachment portion 808 and around the biasing portion 810 of the piston 234. It can therefore be more clearly understood from this view that when the pivot 222 rotates clockwise or counterclockwise, it also moves the flange 236 forward or backward causing the piston to engage or disengage with the openings 113 in the vertical member 112L.

Figure 11A:
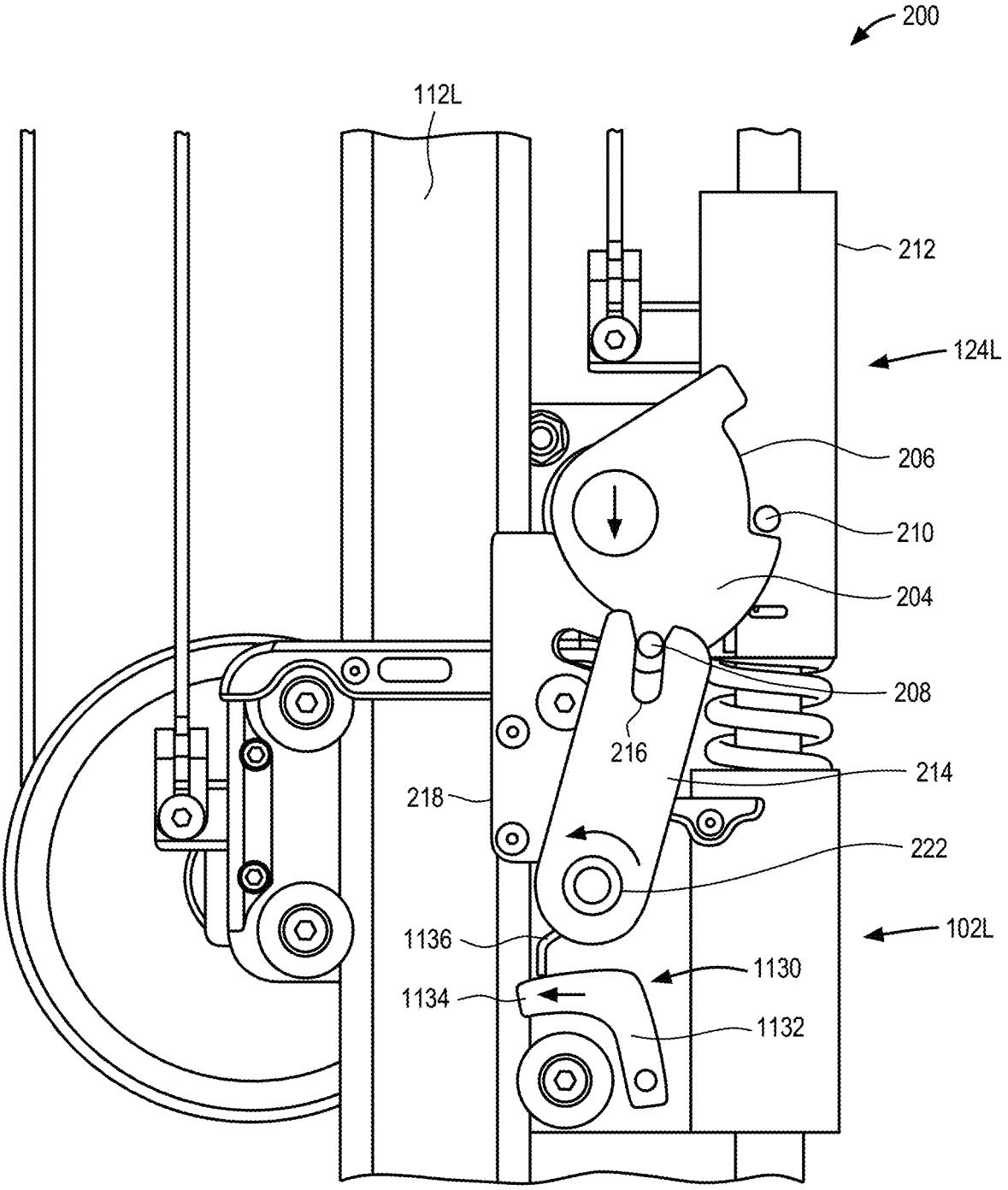
FIG. 11A illustrates a side perspective view of an alternative configuration of a carriage locking mechanism of the exercise apparatus of FIG. 1.
Figure 11B:
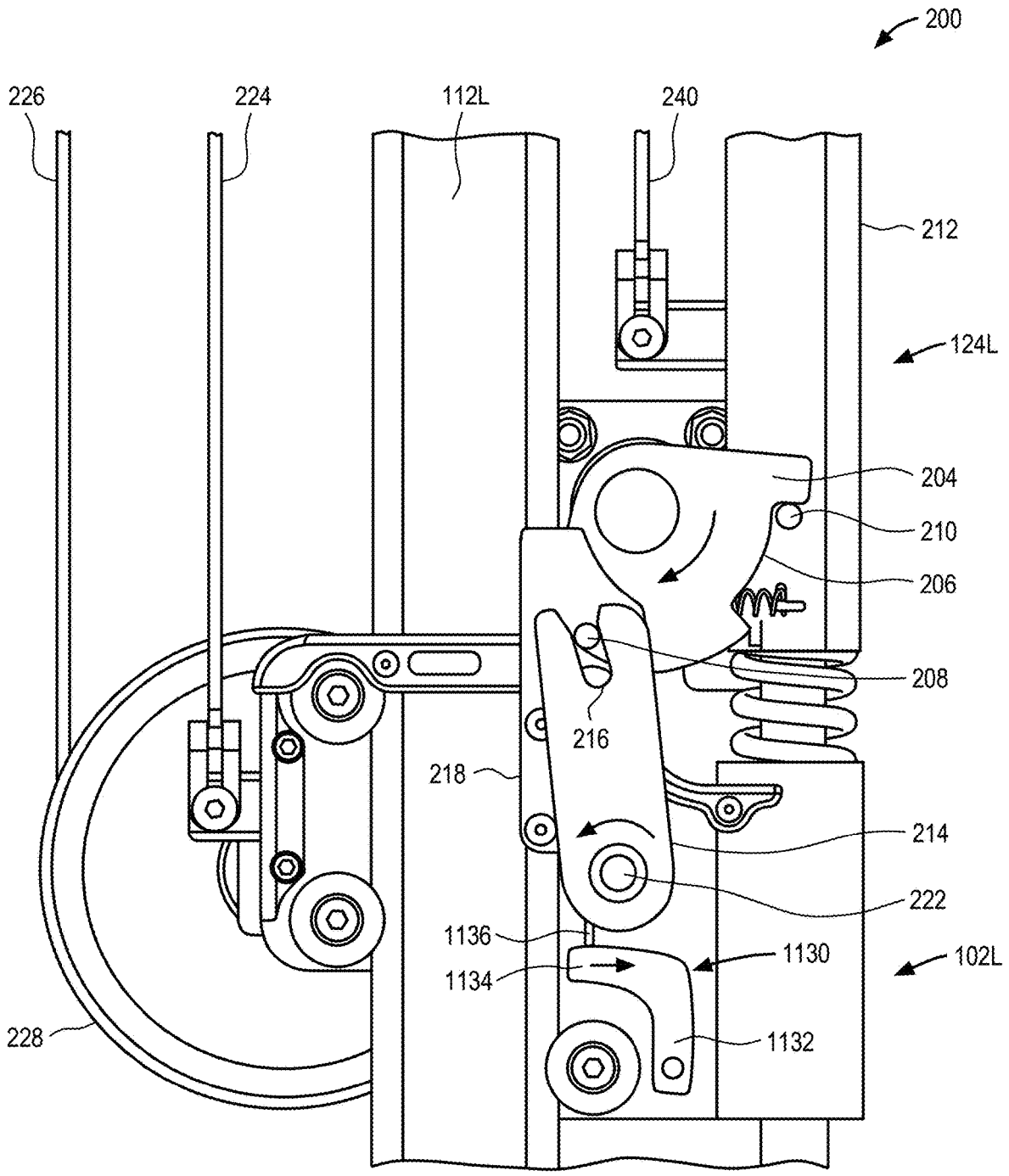
FIG. 11B illustrates a side perspective view of the carriage locking mechanism of FIG. 11A.

FIGS. 11A and 11B illustrate side perspective views of the same carriage locking mechanism previously discussed in reference to FIGS. 1-4. In FIGS. 11A-B, however, an alternative configuration of the lower locking components of the carriage locking mechanism for locking or unlocking the lower carriage 102L to the vertical member 112L are further shown. In particular, it can be seen from FIGS. 11A-B that instead of a locking assembly including a piston as previously discussed in reference to FIGS. 5-10, the lower locking components include a locking assembly 1130 having pin 1134 for locking or unlocking the lower carriage 102L to the vertical member 112L. The pivoting pin assembly 1130 may include a body 1132 pivotally coupled to the lower carriage 102L, a pin 1134 coupled to the body 1132 and a flange 1136 coupling the pin 1134 to the lower carriage lever 214. The pin 1134 may be oriented such that it faces vertically spaced openings formed along the vertical member 112L and is operable to move in or out of the openings when the body 1132 pivots. The pin 1134 is sized to fit within the openings in the vertical member 112L. In this aspect, the pin 1134 can be moved toward the vertical member 112L to engage with an opening in the vertical member 112L or can be moved away from the vertical member 112L to disengage with an opening in the vertical member 112L by pivoting the body 1132. An engagement of the pin 1134 with an opening in the vertical member 112L locks the lower carriage 102L to the vertical member 112L so that it remains at the same vertical position until the pin 1134 is removed from the opening. Once the pin 1134 is removed from the opening, the lower carriage 102L is once again free to slide along the vertical member 112L. The movement of the pin 1134 may be caused by the movement of the lower carriage lever 214 as previously discussed. Representatively, as previously discussed, the pin 1134 is coupled to the lower carriage lever 214 by flange 1136. The flange 136 may include one end that is attached to the lower carriage lever 214 and another end attached to the body 1132. The pin 1134 may be biased toward the engaged position shown in FIG. 11A. In this aspect, the default position is for the lower carriage 102L to remain locked to the vertical member 112L. To disengage the pin 1134 from the vertical member 112L, the bar locking pin 208 is lowered into the lever notch 216 of the lower carriage lever 214 as shown in FIG. 11A by lowering the Smith bar 120 (not shown). Once the bar locking pin 208 engages the lever notch 216 as shown in FIG. 11A, the bar locking pin 208 is moved toward the lower carriage bracket 218 by rotating the Smith bar 120 (e.g., forward toward the upper carriage sleeve 212) as previously discussed, which in turn causes the lower carriage lever 214 to rotate toward the lower carriage bracket 218 as shown by the arrow. This rotation of the lower carriage lever 214 causes the flange 1136 to move the body 1132 and in turn the pin 1134 away from the vertical member 112L as shown by the arrow in FIG. 11B. The movement of the pin 1134 away from the vertical member 112L pulls the pin 1134 out of the opening in the vertical member 112L to the unlocked position shown in FIG. 11B. Once in this unlocked position with the pin 1134 disengaged from the opening of the vertical member 112L, the lower carriage 102L is now free to move along the vertical member 112L along with the upper carriage 124L.

Figure 12:
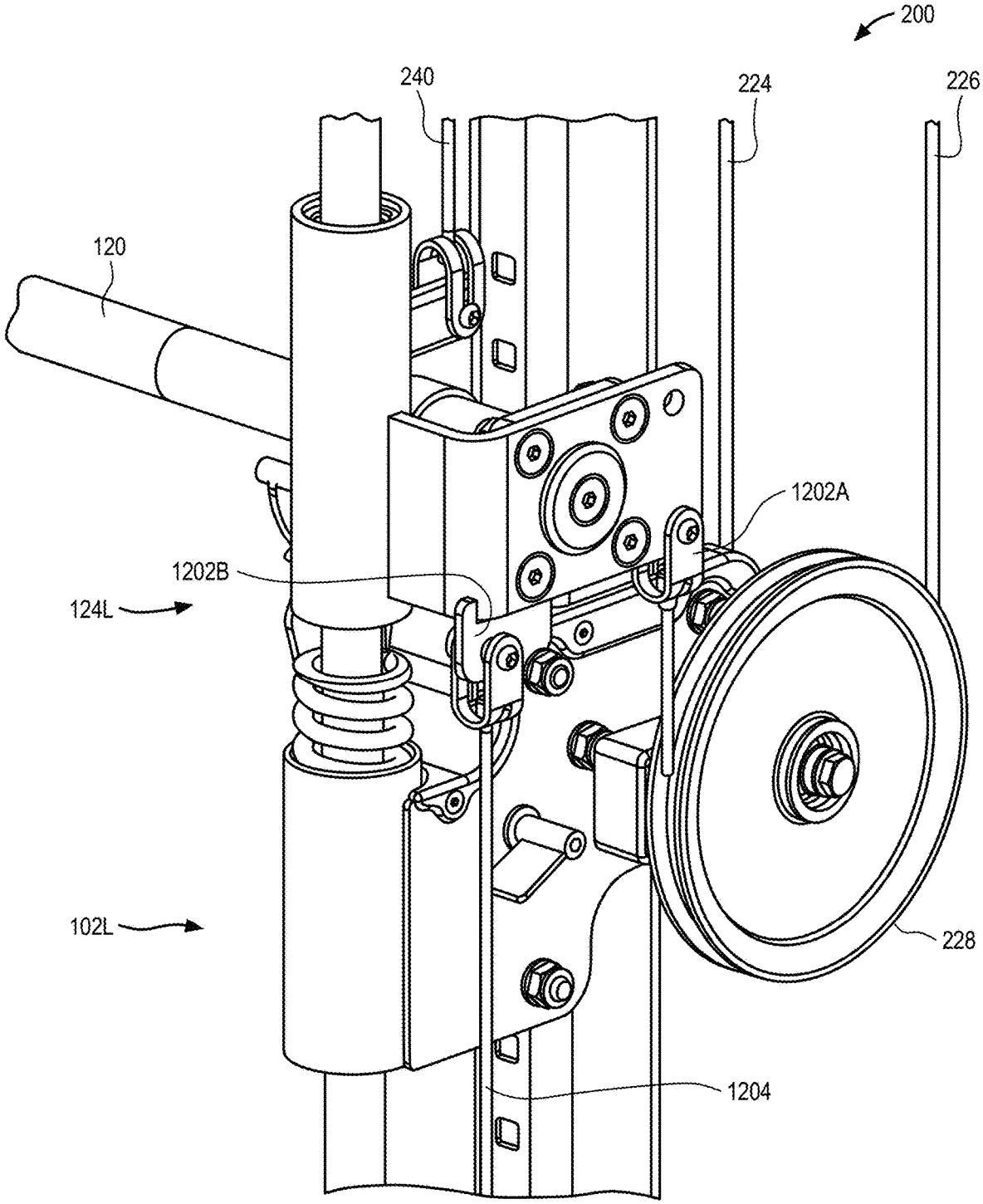
FIG. 12 illustrates a front side perspective view of a carriage locking mechanism of the exercise apparatus of FIG. 1.

FIG. 12 illustrates a front side perspective view of the carriage locking assembly with the pulley system previously discussed in reference to FIG. 2. From this view, it can be seen that cable 226 is reeved around pulley 228 and connected at its end at an attachment bracket 1202A coupled to the Smith bar 120. As previously discussed, a resistance (e.g., weight stack 104L) may be coupled to the Smith bar 120 using the cable 226 and pulley 228 to provide resistance when lifting the Smith bar 120. In addition, cable 1204 may be connected at its end to attachment bracket 1202B coupled to the Smith bar 120. Cable 1204 may be used to couple a resistance (e.g., weight stack 104L) to Smith bar 120 in a similar manner to cable 226 (e.g., through a looped cable system).

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims. Representatively, while certain aspects have been described and shown in the accompanying drawings, it is to be understood that such aspects are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting. In addition, to aid the Patent Office and any readers of any patent issued on this application in interpreting the claims appended hereto, applicants wish to note that they do not intend any of the appended claims or claim elements to invoke 35 U.S.C. 112 (f) unless the words "means for" or "step for" are explicitly used in the particular claim.

What is claimed is:

1. An exercise apparatus comprising:

a frame;

first and second vertical guides coupled to the frame;

first and second carriages carried on the respective first and second vertical guides, each of the first and second carriages having a first carriage portion, a second carriage portion and a carriage lock operable to lock and release at least one of the first or second carriage portions to a selected vertical position along the first and second vertical guides, and wherein the carriage lock of each of the first and second carriages requires a same vertical position along the first and second vertical guides for the carriage lock to engage a portion of the first and second vertical guides and remains in a locked position until release; and an exercise bar coupled to the first or second carriage portion of the first and second carriages, the exercise bar operable to actuate the carriage lock.

2. The exercise apparatus of claim 1 wherein the portion of the first and second vertical guides comprise a number of vertically spaced openings at selected vertical positions and the carriage lock comprises a piston that engages with one of the vertically spaced openings to lock the second carriage portion of each of the first and second carriages to the first and second vertical guides.

3. The exercise apparatus of claim 1 wherein the exercise bar translates or rotates to actuate the carriage lock.

4. The exercise apparatus of claim 1 wherein a protruding portion of the carriage lock requires alignment with a hole of each of the respective first and second vertical guides at a same vertical height to lock the second carriage portion.

5. The exercise apparatus of claim 1 wherein the carriage lock comprises a positive lock that engages the first and second vertical guides to lock the first and second carriages to the first and second vertical guides only when each positive lock is at a same vertical height along the first and second vertical guides.

6. The exercise apparatus of claim 1 wherein the carriage lock comprises upper locking components coupled to the first carriage portion and lower locking components coupled to the second carriage portion, and wherein the upper locking components engage or disengage with the lower locking components to lock and release the second carriage portion to the first and second vertical guides.

7. The exercise apparatus of claim 1 wherein the carriage lock comprises a bar bracket fixedly coupled to the exercise bar and a bar locking pin fixedly coupled to the bar bracket, and wherein a rotation of the exercise bar causes the bar locking pin to engage or disengage with a lower carriage bracket coupled to the second carriage portion to lock or unlock the second carriage portion to the first and second vertical guides.

8. The exercise apparatus of claim 1 wherein the carriage lock further comprises a lower carriage lever and a lower carriage bracket, and the lower carriage lever and the lower carriage bracket are coupled to the second carriage portion, and wherein a rotation of the exercise bar causes a bar locking pin coupled to the exercise bar to engage with the lower carriage lever and transition the carriage lock from a locked position in which the second carriage portions are locked to the first and second vertical guides to an unlocked position which unlocks the second carriage portions from the first and second vertical guides.

9. The exercise apparatus of claim 8 wherein the carriage lock comprises an engagement structure biased toward the locked position and a flange coupling the engaging structure to the lower carriage lever, and wherein a rotation of the lower carriage lever in a first direction forces the engagement structure from the locked position to the unlocked position.

10. The exercise apparatus of claim 9 wherein a rotation of the lower carriage lever in a second direction releases the force allowing the engaging structure to transition back to the locked position.

11. The exercise apparatus of claim 1 wherein prior to locking the second carriage portion to the vertical guide, a translation of the exercise bar relative to the first and second vertical guides moves the first carriage portion along the first and second vertical guides while the second carriage portion remains locked at the selected vertical position.

12. An exercise apparatus comprising:

a frame;

at least one vertical guide coupled to the frame;

a carriage carried on the vertical guide, the carriage comprising a first carriage and a second carriage, and a carriage lock comprising a positive lock protrusion operable to lock and release the first or second carriage by engaging or disengaging the at least one vertical guide; and an exercise bar coupled to the first carriage, the exercise bar operable to actuate the carriage lock to lock or release the second carriage relative to the at least one vertical guide.

13. The exercise apparatus of claim 12 wherein the positive lock protrusion is a positive lock piston coupled to the second carriage.

14. The exercise apparatus of claim 13 wherein the positive lock piston is coupled to a housing fixedly coupled to the second carriage and a flange is operable to move the piston from a locked position in which the second carriage is locked to the at least one vertical guide to an unlocked position in which the second carriage is released from the at least one vertical guide.

15. The exercise apparatus of claim 12 wherein the carriage lock only locks and releases the second carriage relative to the at least one vertical guide when it is at a same vertical position as a carriage lock coupled to another carriage of the exercise apparatus.

16. The exercise apparatus of claim 12 wherein the carriage lock comprises upper locking components coupled to the first carriage and lower locking components coupled to the second carriage, and wherein the upper locking components engage or disengage with the lower locking components to lock and release the lower carriage relative to the at least one vertical guide.

17. The exercise apparatus of claim 16 wherein a rotation of the exercise bar causes the upper locking components to engage or disengage with the lower locking components to lock and release the second carriage relative to the at least one vertical guide.

18. The exercise apparatus of claim 16 wherein the upper locking components comprise a bar bracket fixedly coupled to the exercise bar and a bar locking pin fixedly coupled to the bar bracket that engages with the lower locking components.

19. The exercise apparatus of claim 18 wherein the lower locking components comprise a lower carriage bracket fixedly coupled to the second carriage, and a lower carriage lever pivotally coupled to the second carriage, and wherein the bar locking pin engages with the lower carriage lever and the lower carriage bracket to release the second carriage relative to the at least one vertical guide.

20. The exercise apparatus of claim 19 wherein the engagement of the bar locking pin with the lower carriage bracket couples the first carriage to the second carriage.

* * * * *